US006592130B2

(12) United States Patent
Frigo et al.

(10) Patent No.: US 6,592,130 B2
(45) Date of Patent: Jul. 15, 2003

(54) FRAME PARTICULARLY FOR IN-LINE SKATES

(75) Inventors: Flavio Frigo, Ponzano Veneto (IT); Nicola Bonora, Montebelluna (IT)

(73) Assignee: Benetton Group S.p.A., Ponzano Veneto (IT)

( * ) Notice: Subject to any disclaimer, the term of this patent is extended or adjusted under 35 U.S.C. 154(b) by 0 days.

(21) Appl. No.: 10/061,266

(22) Filed: Feb. 4, 2002

(65) Prior Publication Data

US 2002/0117817 A1 Aug. 29, 2002

(30) Foreign Application Priority Data

Feb. 26, 2001 (IT) ..... TV200100017 U

(51) Int. Cl.[7] ..... A63C 17/06

(52) U.S. Cl. ..... 280/11.221; 280/11.27; 280/11.231; 280/11.203

(58) Field of Search ..... 280/11.3, 11.19, 280/11.221, 11.223, 11.231, 11.27, 809, 811, 11.203–11.233, 11.31, 11.32; D21/763, 764

(56) References Cited

U.S. PATENT DOCUMENTS

| | | | | | |
|---|---|---|---|---|---|
| D363,964 | S | * | 11/1995 | Chen | D21/764 |
| 5,533,740 | A | | 7/1996 | Lin | |
| 5,810,369 | A | * | 9/1998 | Wilder et al. | 280/11.231 |
| RE35,993 | E | | 12/1998 | Gierveld | |
| 6,029,983 | A | * | 2/2000 | Wegener | 280/11.231 |
| 6,047,972 | A | | 4/2000 | Rudolph | |
| 6,267,411 | B1 | * | 7/2001 | Balbinot et al. | 280/809 |
| D446,272 | S | * | 8/2001 | Baron et al. | D21/764 |
| 6,293,563 | B1 | * | 9/2001 | Benoit | 280/11.221 |
| 6,308,965 | B1 | * | 10/2001 | Yang | 280/11.221 |
| 6,341,785 | B1 | * | 1/2002 | Benoit | 280/11.221 |
| D465,538 | S | * | 11/2002 | Chen | D21/771 |

FOREIGN PATENT DOCUMENTS

| | | |
|---|---|---|
| EP | 0 617 989 | 10/1994 |
| WO | 97 37731 | 10/1997 |

* cited by examiner

*Primary Examiner*—Brian L. Johnson
*Assistant Examiner*—Brian L Swenson
(74) *Attorney, Agent, or Firm*—Guido Modiano; Albert Josif; Daniel O'Byrne

(57) ABSTRACT

A frame particularly usable for in-line or ice skates, comprising two mutually facing approximately vertical walls, transversely to which there are, along the same longitudinal axis, multiple holes for placing the hubs of respective wheels. The frame has, in a transverse cross-section, an oval shape which is closed in the interspace between at least two adjacent wheels.

4 Claims, 2 Drawing Sheets

FRAME PARTICULARLY FOR IN-LINE SKATES

BACKGROUND OF THE INVENTION

The present invention relates to a frame preferably usable for in-line skates or ice skates.

Said conventional frames are suitable to connect an overlying shoe to a plurality of in-line wheels, which can roll on the ground, or with an ice-skating blade.

Frames are currently in use which have a transverse cross-section, shaped like an inverted letter U, forming an upper base and two lateral wings, or walls, that protrude downward.

Said type of frame, preferably obtained by extrusion and then shaped by multiple milling operations, is associated with the shoe through two or more interconnection means, such as for example two screws that pass through holes provided in the base.

In turn, three or more in-line wheels are associated with the frame by means of respective hubs arranged transversely to said two wings.

U.S. Pat. No. RE-35,993 discloses a supporting device which is associated, in an upper region, with the sole of a shoe for skates and comprises a frame for connection to an ice-skating blade or to at least three rotatable wheels.

Such frame can be obtained from an extruded profiled element that is shaped approximately like an inverted letter U and has three transverse planes, namely an upper one, an intermediate one, and a lower one, arranged approximately horizontally, so as to interconnect two lateral vertical walls below which two facing wings protrude.

Said extruded profiled element can be conveniently machined by removing material so as to obtain a first plate and a second plate that protrude upward in order to engage said shoe.

Said first and second plate, formed respectively at the heel region and the tip region of the foot, have perforated upper walls, so as to allow the passage of means, such as screws, for connection to the sole of the shoe.

The upper surface of the first plate is obtained by machining the upper plane. Otherwise the upper surface of the second plate is preferably obtained by machining the intermediate plane, so that the points of contact between the frame and the shoe arrange themselves on staggered planes.

In said wings, which protrude downward, it is possible to provide slots and holes for the possibly adjustable connection of said wheels.

The main drawback of said conventional skates is that they do not have an adequate rigidity with respect to torsions and lateral forces that can be generated during sports practice.

Accordingly, an excessive stress is applied by said forces to the regions of the frame that lie proximate to the hubs, as well as to the hubs themselves, which, by acting as a connection between the two wings, are necessarily stressed by the weight of the user, by said lateral and torsional forces, and by external forces caused, for example, by accidental impacts or falls.

SUMMARY OF THE INVENTION

The aim of the present invention is therefore to solve the above noted problems, eliminating the drawbacks of the cited prior art, by providing a frame that allows to achieve an optimum distribution of stresses caused not only by vertical forces, such as the weight of the user, but also by the lateral forces that can occur during sports practice.

Within this aim, an important object is to provide a frame that allows to obtain said optimum stress distribution while maintaining a shape that has an advantageous aesthetic impact.

Another object is to provide a frame that maintains a high mechanical strength while being very light.

Another object is to provide a frame that is structurally simple and has low manufacturing costs.

This aim and these and other objects that will become better apparent hereinafter are achieved by a frame, particularly for in-line skates, comprising two mutually facing approximately vertical walls, transversely to which there are, along the same longitudinal axis, multiple holes for placing the hubs of respective wheels, characterized in that it has, in a transverse cross-section, an oval shape which is closed in the interspace between at least two adjacent wheels.

BRIEF DESCRIPTION OF THE DRAWINGS

Further characteristics and advantages of the invention will become better apparent from the detailed description of a particular embodiment thereof, illustrated only by way of non-limitative example in the accompanying drawings, wherein.

DESCRIPTION OF THE PREFERRED EMBODIMENTS

Figure 1:
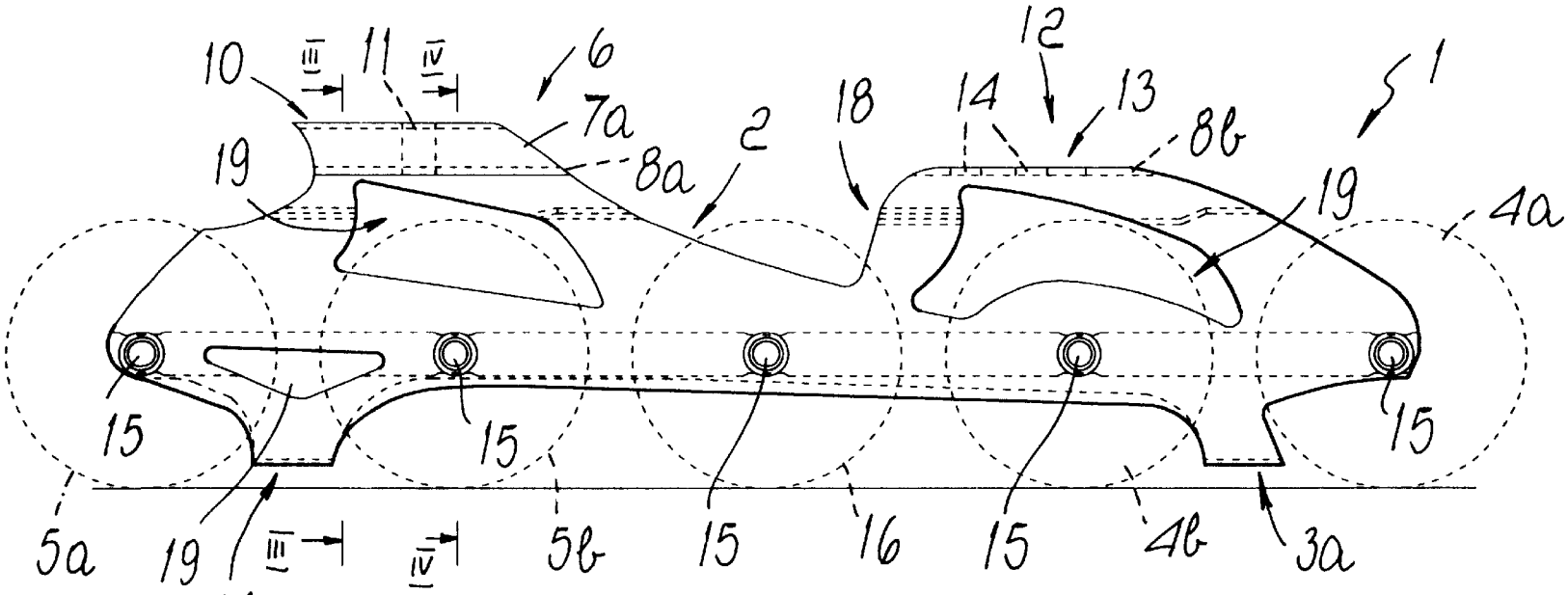
FIGS. 1 and 2 are respectively a side view and a top view of the frame according to the invention.
Figure 2:
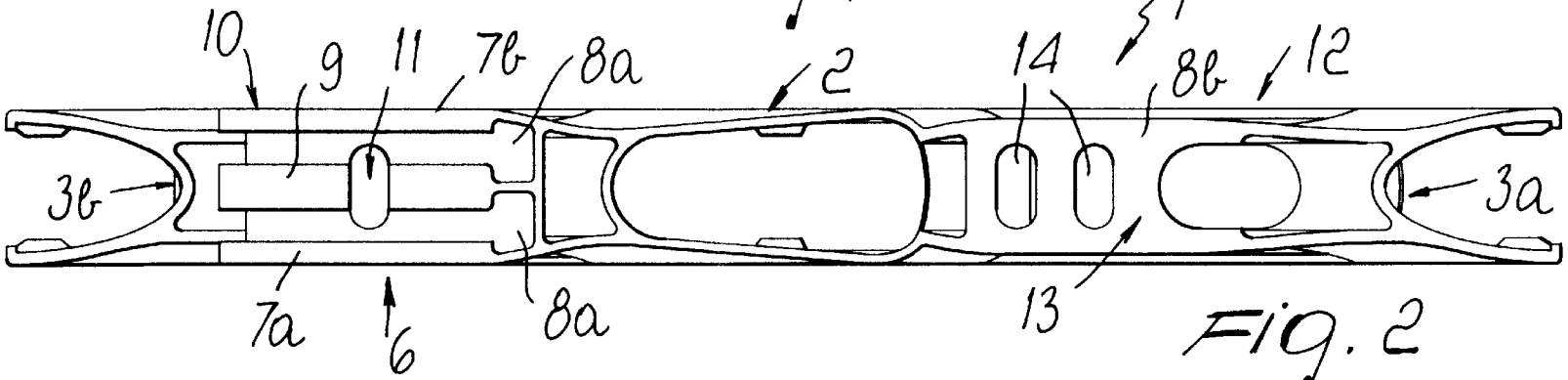

With reference to the figures, the reference numeral 1 designates a frame particularly for use in skates with in-line wheels.

The frame comprises a hollow box-like body, designated by the reference numeral 2, which has an approximately oval transverse cross-section.

In this embodiment, the box-like body 2 is closed downward at a first region 3*a* arranged proximate to the interspace between the first two front wheels, designated by the reference numerals 4*a* and 4*b* in FIG. 1, and at a second region 3*b* arranged proximate to the interspace between the last two rear wheels, designated by the reference numerals 5*a* and 5*b*.

A first wing 7*a* and a second wing 7*b* protrude upward above said box-like body 2 at a third heel region 6. The wings face each other, are approximately L-shaped and are mutually connected by an intermediate transverse plane 8*a,* arranged approximately horizontally.

A third wing, designated by the reference numeral 9, protrudes upward from said transverse plane 8*a,* and is preferably T-shaped and equidistant from the preceding ones so that the free ends of said first, second and third wings 7*a,* 7*b* and 9 constitute a first resting surface 10 for supporting the sole of a shoe, which is arranged above and is not shown in the figures.

The shoe is rigidly coupled to the frame by virtue of a connection preferably provided by means of a mechanical connecting element, such as a screw, which passes in a lower region through a first hole 11 that has a vertical axis and is obtained in the transverse plane 8*a* and in the free end of the third wing 9.

A second resting element 13 for supporting said sole is provided in said frame 1 in a fourth region of the metatarsus, designated by the reference numeral 12.

Said second resting element 13 is conveniently lower than said first resting element 10 arranged at the rear, since the surface for contact with the sole is constituted by a separate transverse plane 8*b* arranged on the same horizontal plane as said transverse plane 8*a*.

One or more second holes, designated by the reference numeral 14, are formed in the separate transverse plane 8*b* and allow connection to said sole by means of connection elements and in manners that are similar to those already described for the heel region.

Multiple holes 15 are formed laterally, along the same longitudinal axis, in the box-like body 2, for arranging hubs associated with said wheels 4*a*, 4*b*, 5*a* and 5*b* and optionally also with one or more intermediate wheels designated by the reference numeral 16.

Figure 4:
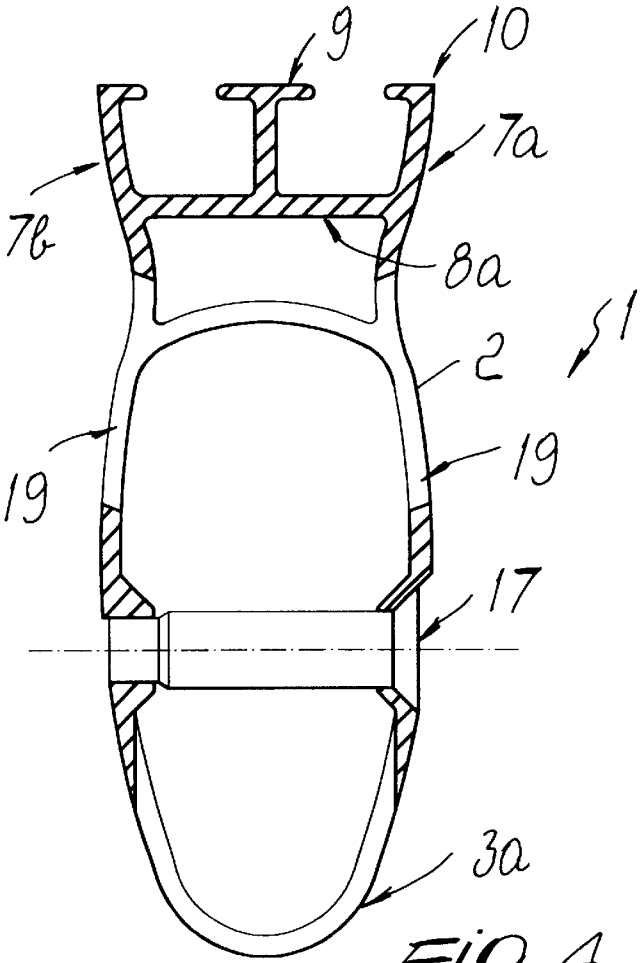
FIGS. 3 and 4 are front transverse sectional views, according to two different section planes, of the frame according to the invention.
Figure 3:
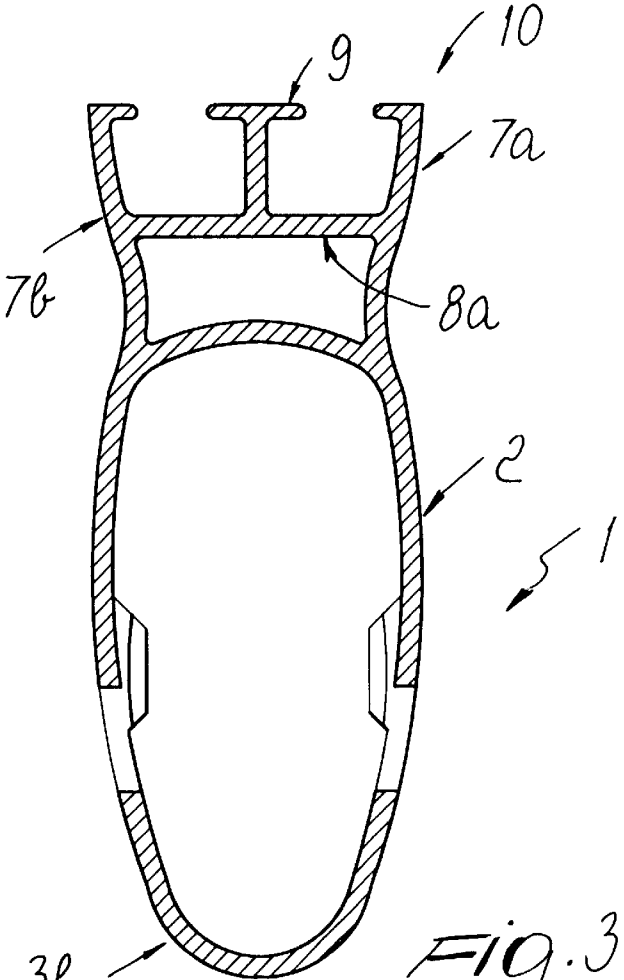

In FIG. 4, the numeral 17 designates one of said hubs, particularly the one associated with the wheel 5*b* arranged in front of the second region 3*b*.

Recesses 18 and openings 19 are formed in the frame 1 for reducing the weight of the frame without altering its characteristics of rigidity and mechanical strength.

The operation of the frame is therefore as follows: with reference to FIG. 1, the wheels 4*a*, 4*b*, 5*a*, 5*b* and 16 are rotatably associated with the frame at the holes 15.

The first and second resting elements 10 and 13 allow connection to the overlying sole of said sports shoe: this connection occurs so that the metatarsal region 12 of the foot arranges itself at a lower height from the ground than the heel region 6, so as to allow the user to maintain a foot posture which, by contributing to shift the center of gravity forward, facilitates sports practice.

It has thus been observed that the invention has achieved the intended aim and objects, a frame having been provided that allows to achieve an optimum distribution of both vertical forces, such as weight, and lateral forces generated during sports activity.

The frame according to the invention is also very light and has a shape that has an advantageous aesthetic impact.

The materials used, as well as the dimensions that constitute the individual components of the invention, may of course be more pertinent according to specific requirements.

The disclosures in Italian Utility Model Application No. TV2001U000017 from which this application claims priority are incorporated herein by reference.

What is claimed is:

1. A frame for in-line skates, comprising two mutually facing approximately vertical walls, transversely to which there are, along a same longitudinal axis, multiple holes for placing hubs of respective wheels, said frame having, in a transverse cross-section, an oval shape which is closed in an interspace thereof between at least two adjacent wheels, the frame further comprising a hollow box-like body having an approximately oval transverse cross-section, which is closed downwardly at a base of the frame in at least one region, a first wing and a second wing which face each other protruding upward above said box-like body at a heel region of the frame, said first and second wings, which are approximately L-shaped, being mutually connected by means of an intermediate transverse plane, which is arranged approximately horizontally, a third wing protruding upward from said transverse plane and being T-shaped and equidistant from said first and second wings.

2. The frame according to claim 1, wherein said box-like body is closed downwardly at the base of the frame at a first region, located proximate to the interspace between two frontmost wheels, and proximate to a second region located proximate to the interspace between two rearmost wheels.

3. The frame according to claim 1, wherein upwardly extending portions of said first, second and third wings constitute a first resting element suitable for connection to the sole of a shoe for skates arranged upward.

4. The frame according to claim 3, wherein a second resting element for connection to said sole is obtained in said frame in a fourth region that lies proximate to the metatarsus of the shoe for the skate, said second resting element being constituted by a separate transverse plane that lies on the same horizontal plane as said transverse plane of said first resting element.

* * * * *